US006300598B1

(12) United States Patent
Chiles et al.

(10) Patent No.: US 6,300,598 B1
(45) Date of Patent: Oct. 9, 2001

(54) ELECTRICAL MONITOR FOR FLOOR HEATING SYSTEMS

(75) Inventors: Richard M. Chiles; Daniel T. Chiles, both of Springfield, MO (US)

(73) Assignee: Bask Technologies LLC, Springfield, MO (US)

( * ) Notice: Subject to any disclaimer, the term of this patent is extended or adjusted under 35 U.S.C. 154(b) by 0 days.

(21) Appl. No.: 09/648,043

(22) Filed: Aug. 25, 2000

(51) Int. Cl.[7] ..... H05B 1/00

(52) U.S. Cl. ..... 219/213; 219/506; 219/528; 219/529; 219/545

(58) Field of Search ..... 219/213, 211, 219/212, 217, 219, 481, 497, 506, 509, 526, 528, 529, 544, 545, 549

(56) References Cited

U.S. PATENT DOCUMENTS

| | | | | |
|---|---|---|---|---|
| 3,582,612 | * | 6/1971 | Siemianowski | 219/213 |
| 3,947,658 | * | 3/1976 | Sato et al. | 219/481 |
| 4,439,666 | * | 3/1984 | Graham | 219/213 |
| 4,581,522 | * | 4/1986 | Graham | 219/545 |
| 4,878,332 | * | 11/1989 | Drake | 219/213 |
| 4,899,031 | * | 2/1990 | Dyer | 219/213 |
| 5,371,340 | * | 12/1994 | Stanfield | 219/217 |
| 5,550,349 | * | 8/1996 | Bomba | 219/213 |
| 5,591,365 | * | 1/1997 | Shields | 219/213 |
| 5,643,482 | * | 7/1997 | Sandelman et al. | 219/497 |
| 5,710,408 | * | 1/1998 | Jones | 219/506 |
| 5,763,858 | * | 6/1998 | Jones | 219/506 |
| 5,785,064 | * | 7/1998 | Simpson | 219/219 |
| 5,900,178 | * | 5/1999 | Johnsen | 219/497 |
| 6,004,418 | * | 12/1999 | Ginman et al. | 219/217 |
| 6,084,207 | * | 7/2000 | Jones | 219/213 |
| 6,104,352 | * | 8/2000 | Jones | 219/213 |
| 6,107,611 | * | 8/2000 | Jones | 219/509 |

* cited by examiner

*Primary Examiner*—Teresa Walberg
*Assistant Examiner*—Fadi H. Dahbour
(74) *Attorney, Agent, or Firm*—Shook, Hardy & Bacon LLP

(57) ABSTRACT

A monitor for use during installation of under floor warming mats to monitor the condition of the electric heating elements. Three lead wires extending from the monitor have alligator clips allowing them to be clipped to the hot, neutral and ground leads of the heating elements. A monitoring circuit generates an audible alarm if the hot or neutral wire is cut or if the ground sheath is electrically connected to either the hot or neutral wire.

14 Claims, 2 Drawing Sheets

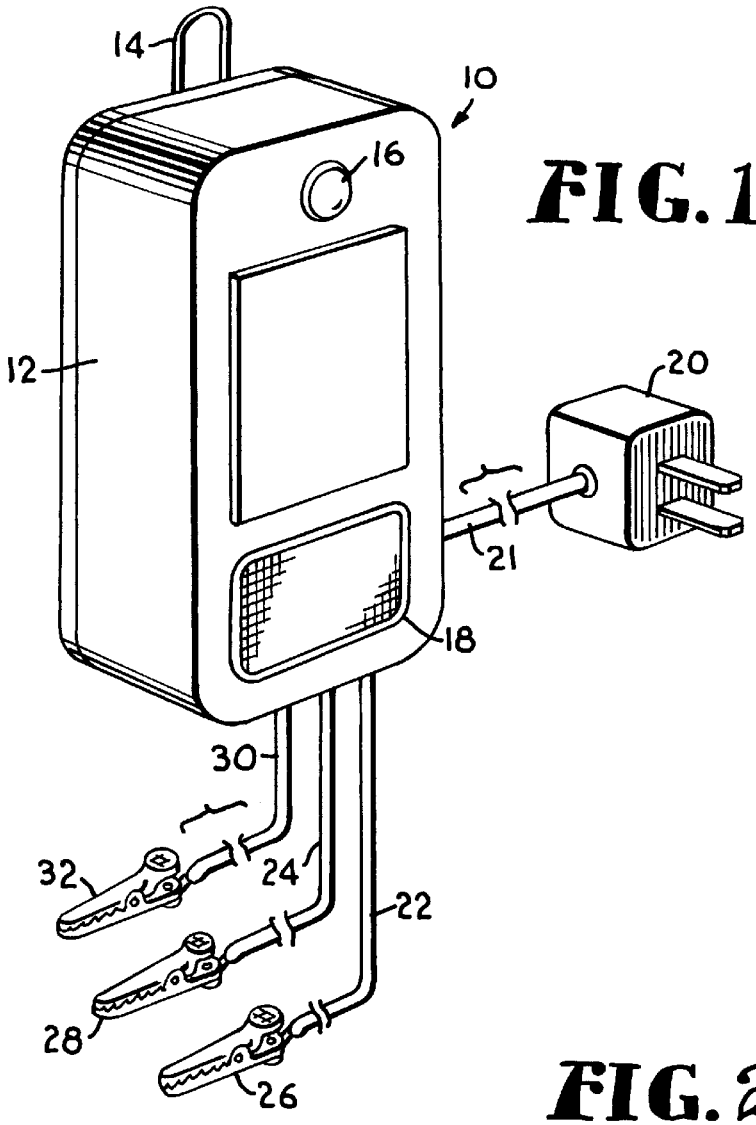
FIG. 1.
FIG. 2.
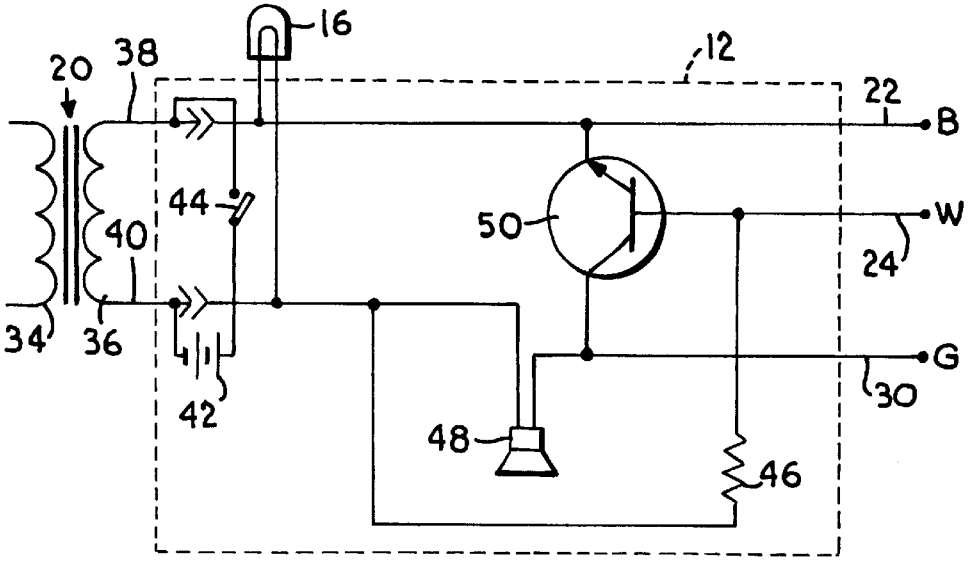

ELECTRICAL MONITOR FOR FLOOR HEATING SYSTEMS

FIELD OF THE INVENTION

This invention relates generally to electric floor warming systems of the type having a meshwork heating mat equipped with electrically resistive heating elements for applying heat to finished flooring. More particularly, the invention is directed to a monitor for monitoring the electrical condition of the circuitry while the floor warming system is being installed.

BACKGROUND OF THE INVENTION

Electric floor heating systems typically include meshwork mats which have electric heating elements threaded through them to distribute the heat uniformly throughout the floor. The mat construction is embedded in the substrate of the floor and is then covered with finish flooring materials such as tile, marble, stone, wood, vinyl, carpet or another type of floor covering.

Problems can arise during the course of the installation because it is normal for two different professional trade groups to be involved. A floor covering tradesman usually is involved in installing the meshwork mat and embedding it in the flooring, typically in mortar or another similar base in which tile or stone is set. After the mat has been permanently embedded in place in the floor, an electrician normally completes the electrical connection of the system to a power source and a control device such as a thermostat and/or timer.

Floor covering tradesmen do not normally have training or expertise in electronics, house wiring or heating element technology. It is not uncommon for the flooring personnel to damage the heating elements during their installation work. Further, the damaged heating element, unbeknownst to anyone, may be covered by the flooring personnel with finished flooring before the electrician shows up to notice that the system is not able to function properly. At that point, it is necessary to tear up the floor in order to gain access to the damaged area of the wires and effect the necessary repairs. It is not uncommon for the entire floor covering to be torn up and removed in such an instance. Obviously, the costs of material, labor and delay involved in this type of repair is significant, particularly when the floor covering is tile, stone or marble which is set in a mortar bed or the like.

At present, the technology that is prevalent for monitoring the floor heating system during installation involves use of an ohmmeter which measures the resistance of the wires and provides a read out either on a scale or on a display. Non-electricians, including flooring installers, often find it difficult at best to calibrate an ohmmeter. In any event, an ohmmeter is unable to completely monitor all of the potential problems that can arise during installation and is unable to provide an indication of all types of wire damage that might occur.

Typical damage to the resistance elements takes place when flooring professionals or carpenters drive nails or staples into the flooring and pierce the ground shield that normally surrounds the hot and neutral wires. The metal fastener can create a short circuit between the ground conductor and either the hot or neutral conductor, thus creating a malfunction in the wiring system. Another type of problem that can occur results from a fastener being driven through either the hot or neutral wire in order to create a discontinuity. Unless problems of this type are recognized when they occur, the damage can be covered up by finished flooring and necessitate later tearing up of the floor.

SUMMARY OF THE INVENTION

The present invention is directed to an electrical monitoring device which is used during the installation of electrical floor warming mats to constantly monitor the electrical condition of the heater wiring associated with the mat. In the event of an electrical problem, an alarm signal is immediately generated to allow corrective action to be taken before the finished flooring has been fully installed.

In accordance with the invention, a monitor housing is equipped with three monitor wires each having an alligator type clip on its end. The lead wiring for the floor heating elements includes hot and neutral wires and a ground wire. The three clips can be applied to the lead wiring so that the electrical connections remain established throughout the installation of the floor warming system. Preferably, the wires leading from the monitor are color coded to correspond with the colors of the heating element leads.

The monitor has an electronic circuit to which the monitor wires connect. The circuit may include a light that indicates when the monitor is operating. An alarm system operated by the circuit produces an audible signal if the hot or neutral wire is electrically connected with the ground wire, or if there is a discontinuity in the hot or neutral wire. Thus, if a nail or staple penetrates the ground shield and connects it with either the hot or neutral wire the alarm is sounded. Similarly, if a fastener cuts through either the hot or neutral wire, the alarm sounds to indicate an electrical problem. As a result of the alarm system, the damaged wiring car be repaired before the installation of the finished flooring is completed, thus avoiding the problem of having to tear up finished flooring in order to repair underlying wiring.

BRIEF DESCRIPTION OF THE DRAWINGS

In the accompanying drawings which form a part of the specification and are to be read in conjunction therewith and in which like reference numerals are used to indicate like parts in the various views:

FIG. 1 is a perspective view of a monitor constructed according to a preferred embodiment of the present invention, with the break lines in the wiring indicating continuous length;

FIG. 2 is a schematic diagram of the circuitry of the monitor; and

DETAILED DESCRIPTION OF THE INVENTION

Figure 3:
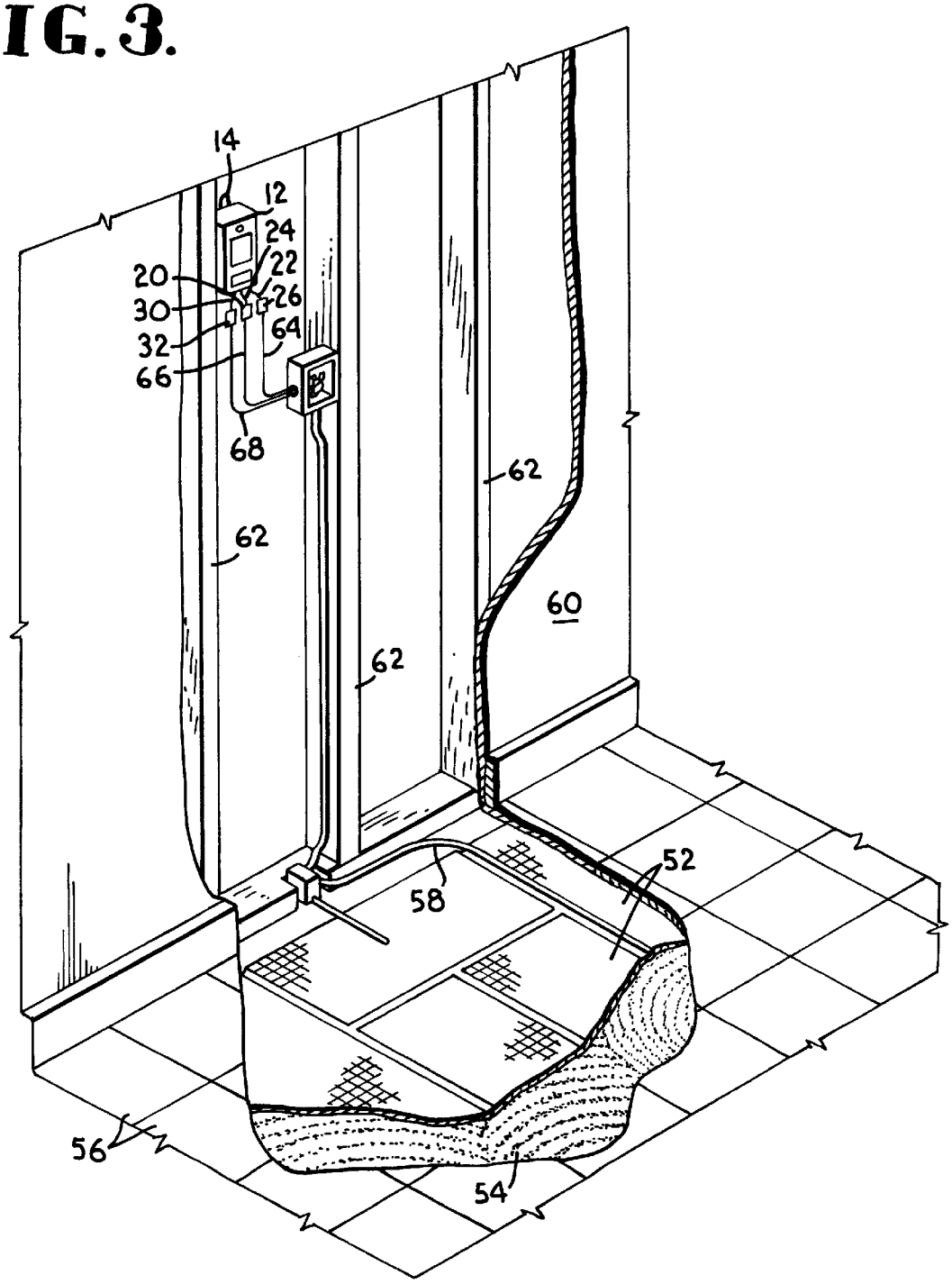
FIG. 3 is a perspective view showing the monitor in use to monitor the condition of the heating wire used in an electric floor warming system.

Referring now to the drawings in more detail and initially to FIG. 1, numeral 10 generally designates a monitor which is used to monitor the electrical condition of electrically resistive heater wires included in an electric floor warming system. The monitor 10 has a box-shaped housing 12 which may be equipped with a hanger 14 allowing it to be hung on a wall or other support during operation of the unit. The front panel of the housing 12 is provided with an LED 16 or other visual indicator. A speaker 18 is also provided on the front panel of the housing 12 in order to provide an alarm signal as will be explained more fully.

The housing 12 is equipped with a conventional transformer 20 which may be plugged into a wall receptacle or other source of alternating current power. Suitable wiring 21 connects the body of the transformer with the housing. Extending from the housing 12 are three monitor wires, including a wire 22 that may be connected with h lot lead wiring and a neutral wire 24 that may be connected with neutral lead wiring. Wire 22 is provided on its free end with an alligator type clip 26. A similar alligator clip 28 is provided on the end of the neutral wire 24. The clips 26 and 28 may be detachably applied to wiring in a manner that is well known. A third monitor wire 30 extends from the housing 12 and may be connected with a ground lead. An alligator clip 32 is provided on the end of the third wire 30.

FIG. 2 depicts an electronic circuit which is contained within the housing 12 and acts to monitor the electrical condition of a floor warming system that is undergoing installation. The transformer 20 has a primary side 34 and a secondary side 36 which is connected across a pair of conductors 38 and 40. A battery 42 is preferably connected across the conductors 38 and 40 in parallel to the transformer secondary side 36 in order to supply power in the event that AC power is not available. A suitable switch 44 may be provided in series with the battery 42. The battery may be connected as an alternative to the transformer, using suitable jacks to connect either the transformer or battery to the circuitry. The LED 16 is connected between the conductors 38 and 40 and is thus energized whenever power is applied to the conductors 38 and 40 by the transformer 20 or battery 42.

The hot monitor wire 22 is connected with conductor 38. Conductor 40 connects through a resistor 46 with the neutral monitor wire 24. Conductor 40 also connects with the ground monitor wire 30 through a speaker 48.

The monitor circuit also includes a transistor 50 Laving its base connected with the neutral monitor wire 24. The other terminals of the transistor i0 are connected with the ground monitor wire 30 and the hot monitor wire 22.

Referring now to FIG. 3, the monitor 10 is used during the installation of an electric floor warming system of the type which includes one or more meshwork heating mats 52. The mats are set in mortar 54 or in another manner beneath finished flooring such as tiles 56. The floor warming system includes cold lead wiring 58 which supplies current to resistive heating wires which are woven throughout the meshwork of the mats 52. The cold lead wiring 58 extends from the mats 52 and is routed along the floor and into the interior of a wall 60 which may be framed using wall studs 62.

With continued reference to FIG. 3 in particular, the cold lead wiring 58 includes a hot conductor 64 to which the alligator clip 26 is applied in order to electrically connect wire 22 with the hot conductor 64. The cold lead wiring also includes a neutral conductor 66 which is connected with wire 24 by means of the alligator clip 28. Finally, a ground conductor 68 in the lead wiring for the mat is connected with wire 30 by means of the alligator clip 32. The housing 12 may be hung on a nail or other fastener temporarily applied to one of the wall studs 62.

In use, the monitor 10 is supplied from the factory with the alligator clips 26 and 28 connected together. Before the installation of the heating mats 52 begins, the transformer 20 is plugged into a receptacle if available, or the battery 42 is used (with switch 44 closed) if alternating current power is not available. Because of the connection between clips 26 and 28, wires 22 and 24 are connected so that the transistor 50 is in a nonconductive condition. The LED 16 is energized to provide a visual indication that the monitor 10 is in operational condition with power applied.

The monitor is used by disconnecting the clamps 26 and 28 and applying them respectively to the cold lead wires 64 and 66. The other clip 32 is clipped onto the ground lead wire 68. When the clips 26 and 28 are disconnected from one another, the open circuit condition of wires 22 and 24 results in the transistor 50 becoming conductive, and the circuit is then completed through the alarm 48. The alarm provides an audible signal through the speaker 18 to notify the installing personnel that the monitor is functioning properly.

During normal installation of the heating mat 52, the heater wires provide a complete circuit between the hot lead wire and the neutral lead wire 24. The transistor 50 is thus normally nonconductive, and the alarm 48 is inactive.

In the event that a nail, staple or other fastener is driven through the ground sheath to establish electrical contact through the fastener between the ground wire 68 and either the hot or neutral wire 64 or 66, the ground monitor wire 30 is thereby connected with either the hot monitor wire 22 or the neutral wire 24. In this condition, the circuit is completed through the alarm 48 and the alarm is then sounded to indicate damaged wiring. Similarly, if the hot wire 64 or neutral wire 66 is severed by a fastener or otherwise, there is a discontinuity between wires 22 and 24 which are normally connected through the heater wires. The discontinuity creates an open circuit condition so that current is then applied to the base of the transistor 50, making the transistor conductive and completing a circuit through the alarm 48. The alarm 48 then provides an alarm signal indicating that the wiring has been damaged.

In this manner, damage to the wiring is immediately detected, and the problem can be located and repaired before tiles 56 or other finish flooring materials are applied.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

Having thus described the invention, what is claimed is:

1. A monitor for monitoring the electrical condition of a meshwork mat interior floor warming system during installation of the floor warming system, said system having an electrically resistive heating element with a hot conductor, a neutral conductor and a ground conductor, said monitor comprising:

a housing;

a first monitor wire extending from the housing and carrying a clip connector applicable to the hot conductor;

a second monitor wire extending from the housing and carrying a clip connector applicable to the neutral conductor;

a third monitor wire extending from the housing and carrying a clip connector applicable to the ground conductor;

an electrical circuit in the housing connected to said monitor wires and arranged to effect a normal condition of the circuit when the hot and neutral conductors are both electrically isolated from the ground conductor, and an abnormal condition of the circuit when either the hot or neutral conductor is electrically connected with the ground conductor; and an alarm in the housing operable to provide an alarm signal in the abnormal condition of the circuit, each of said clip connectors being detachable from the corresponding conductor to allow detachment of said monitor from the floor warming system after installation of the system is complete.

2. A monitor as set forth in claim 1, wherein said circuit is arranged to effect the abnormal condition thereof when either the hot or neutral conductor exhibits a discontinuity.

3. A monitor as set forth in claim 1, including means for applying power to said circuit and a visual indicator energized when power is applied to said circuit.

4. A monitor as set forth in claim 1, including a hanger on said housing allowing the housing to hang on a support.

5. A monitor as set forth in claim 1, wherein said alarm signal comprises an audible signal.

6. In combination with a meshwork mat interior floor warming system having a meshwork mat, an electrically resistive heating element woven through the mat and connected with lead wiring which includes hot and neutral conductors and a ground conductor, an electrical monitor for monitoring the electrical condition of said mat during installation thereof in an interior floor, comprising:

a housing;

a first monitor wire extending from the housing and detachably clipped to the hot conductor;

a second monitor wire extending from the housing and detachably clipped to the neutral conductor;

a third monitor wire extending from the housing and detachably clipped to the ground conductor; and an electrical circuit in the housing connected to said monitor wires and including an alarm operable when activated to generate an alarm signal, said circuit being arranged to activate said alarm when either the hot or neutral conductor is electrically connected with the ground conductor and said monitor wires being detachable from the corresponding conductors to allow detachment of said monitor from the floor warming system after installation of the system is complete.

7. The invention of claim 6, wherein said circuit is arranged to activate said alarm when either the hot or neutral conductor exhibits a discontinuity.

8. The invention of claim 6, wherein said monitor includes means for applying power to said circuit and an indicator energized when power is applied to said circuit.

9. The invention of claim 6, wherein said alarm signal comprises an audible signal.

10. An electrical monitor for a meshwork interior floor heating mat incorporating a heating element having hot and neutral conductors and a ground conductor, said monitor being used during installation of said mat in an interior floor and comprising:

a housing;

a first monitor wire extending from the housing and carrying a clip connector detachably applicable to the hot conductor;

a second monitor wire extending from the housing and carrying a clip connector detachably applicable to the neutral conductor;

a third monitor wire extending from the housing and carrying a clip connector detachably applicable to the ground conductor;

an electrical circuit in the housing connected to said monitor wires and arranged to effect an abnormal condition of the circuit when either the hot or neutral conductor exhibits a discontinuity; and an alarm in the housing operated by the circuit to generate an alarm signal in the abnormal condition thereof each of said clip connectors being detachable from the corresponding conductor to allow detachment of said monitor from said heating element after installation of said mat is completed.

11. A monitor as set forth in claim 10, wherein said circuit is arranged to effect the abnormal condition thereof when said ground conductor is electrically connected to either the hot or neutral conductor.

12. A monitor as set forth in claim 11, wherein said alarm signal comprises an audible signal.

13. A monitor as set forth in claim 10, wherein said alarm signal comprises an audible signal.

14. A monitor as set forth in claim 10, including a hanger on said housing allowing the housing to be hung on a support.

* * * * *